US012357080B2

(12) United States Patent
Lin

(10) Patent No.: US 12,357,080 B2
(45) Date of Patent: Jul. 15, 2025

(54) SYSTEM AND METHOD FOR TOOTHBRUSH MONITORING USING MAGNETO-INDUCTIVE COIL SENSOR

(71) Applicant: The Research Foundation for The State University of New York, Albany, NY (US)

(72) Inventor: Shan Lin, Jericho, NY (US)

(73) Assignee: THE RESEARCH FOUNDATION FOR THE STATE UNIVERSITY OF NEW YORK, Albany, NY (US)

( * ) Notice: Subject to any disclaimer, the term of this patent is extended or adjusted under 35 U.S.C. 154(b) by 692 days.

(21) Appl. No.: 17/620,810

(22) PCT Filed: Jun. 19, 2020

(86) PCT No.: PCT/US2020/038594
§ 371 (c)(1),
(2) Date: Dec. 20, 2021

(87) PCT Pub. No.: WO2020/257555
PCT Pub. Date: Dec. 24, 2020

(65) Prior Publication Data

US 2022/0346543 A1 Nov. 3, 2022

Related U.S. Application Data

(60) Provisional application No. 62/864,858, filed on Jun. 21, 2019.

(51) Int. Cl.
*A46B 15/00* (2006.01)

(52) U.S. Cl.
CPC ..... *A46B 15/0002* (2013.01); *A46B 15/0006* (2013.01); *A46B 2200/1066* (2013.01)

(58) Field of Classification Search
None
See application file for complete search history.

(56) References Cited

U.S. PATENT DOCUMENTS 4,249,117 A 2/1981 Leukhardt et al.
6,735,263 B1 * 5/2004 Moriya ..... H04L 5/06 375/376

(Continued)

FOREIGN PATENT DOCUMENTS

CN 201188565 Y 1/2009
CN 202983134 U 6/2013

(Continued)

OTHER PUBLICATIONS

Li, Kai & Li, Yuan & Han, Yan. (2017). A Magnetic Induction-Based Highly Dynamic Rotational Angular Rate Measurement Method. IEEE Access. pp. 1-1 (Year: 2017).*

Liu, J., "A novel motion generation strategy for robotic tooth brushing simulator", Industrial Robot, 2013, pp. 355-362, vol. 40, No. 4.

(Continued)

*Primary Examiner* — Roy Y Yi
(74) *Attorney, Agent, or Firm* — Scully, Scott, Murphy & Presser, P.C.

(57) ABSTRACT

A system and method for monitoring and analyzing activities of a user operating an electric tooth brush having an electric motor. The magnetic field induced by motions of the electric motor can be detected by a sensor array to generate signals. The signals are processed to determine a position of the brush head and a roll angle of the brush head. Based on the position and roll angle of the brush head, the surface of the teeth of the user, which is being brushed by the brush head, can be determined. This operation can be repeated to determine whether all the surfaces of the teeth have been brushed.

24 Claims, 16 Drawing Sheets

(56) References Cited

U.S. PATENT DOCUMENTS

| | | | | |
|---|---|---|---|---|
| 8,684,922 | B2 | 4/2014 | Tran | |
| 8,747,336 | B2 | 6/2014 | Tran | |
| 9,028,405 | B2 | 5/2015 | Tran | |
| 9,060,683 | B2 | 6/2015 | Tran | |
| 9,597,014 | B2 | 3/2017 | Venkatraman et al. | |
| 9,599,632 | B2 | 3/2017 | Yuen | |
| 9,865,176 | B2 | 1/2018 | Tran | |
| 9,907,473 | B2 | 3/2018 | Tran | |
| 9,960,716 | B2 | 5/2018 | Ambruson et al. | |
| 9,993,166 | B1 | 6/2018 | Johnson et al. | |
| 10,004,451 | B1 | 6/2018 | Proud | |
| 10,054,465 | B2 | 8/2018 | Fedtke | |
| 10,058,290 | B1 | 8/2018 | Proud | |
| 10,064,711 | B1 * | 9/2018 | Richter | A61C 17/221 |
| 10,209,365 | B2 | 2/2019 | Venkatraman et al. | |
| 10,456,883 | B2 | 10/2019 | Rivers et al. | |
| 10,459,109 | B2 | 10/2019 | Fan et al. | |
| 10,459,611 | B1 | 10/2019 | Sculley et al. | |
| 10,556,356 | B2 | 2/2020 | Rivers et al. | |
| 10,607,081 | B2 | 3/2020 | Wexler et al. | |
| 10,610,111 | B1 | 4/2020 | Tran | |
| 10,681,519 | B1 | 6/2020 | Zalewski et al. | |
| 10,687,193 | B2 | 6/2020 | Booth et al. | |
| 10,772,538 | B1 | 9/2020 | Elhawary et al. | |
| 10,842,523 | B2 | 11/2020 | Shelton, IV et al. | |
| 10,977,907 | B1 | 4/2021 | Zalewski et al. | |
| 10,984,146 | B2 | 4/2021 | Santarone et al. | |
| 11,158,179 | B2 | 10/2021 | Tunnell | |
| 11,179,175 | B2 | 11/2021 | Houser et al. | |
| 2003/0053235 | A1 | 3/2003 | Kikugawa et al. | |
| 2005/0146296 | A1 | 7/2005 | Klemm et al. | |
| 2008/0252446 | A1 | 10/2008 | Dammertz | |
| 2009/0069671 | A1 | 3/2009 | Anderson | |
| 2010/0308999 | A1 | 12/2010 | Chornenky | |
| 2011/0010876 | A1 | 1/2011 | Iwahori et al. | |
| 2011/0294096 | A1 * | 12/2011 | deCastro | A61C 17/221 15/105 |
| 2012/0310593 | A1 | 12/2012 | Bates et al. | |
| 2013/0289384 | A1 | 10/2013 | Jenison et al. | |
| 2014/0327382 | A1 | 11/2014 | Fair et al. | |
| 2015/0068069 | A1 | 3/2015 | Tran et al. | |
| 2015/0156567 | A1 | 6/2015 | Oliver et al. | |
| 2015/0164377 | A1 | 6/2015 | Nathan et al. | |
| 2015/0206409 | A1 | 7/2015 | Visvanathan et al. | |
| 2015/0230594 | A1 | 8/2015 | De Vries et al. | |
| 2015/0269825 | A1 | 9/2015 | Tran | |
| 2015/0314166 | A1 | 11/2015 | Hong et al. | |
| 2015/0359467 | A1 | 12/2015 | Tran | |
| 2016/0258758 | A1 | 9/2016 | Houston et al. | |
| 2017/0086672 | A1 | 3/2017 | Tran | |
| 2017/0188864 | A1 | 7/2017 | Drury | |
| 2017/0188895 | A1 | 7/2017 | Nathan | |
| 2017/0245806 | A1 | 8/2017 | Elhawary et al. | |
| 2018/0017623 | A1 | 1/2018 | Zillinger et al. | |
| 2018/0295979 | A1 | 10/2018 | Miller et al. | |
| 2019/0131898 | A1 | 5/2019 | Rivera et al. | |
| 2019/0196438 | A1 | 6/2019 | Rivers et al. | |
| 2019/0197861 | A1 | 6/2019 | Tunnell | |
| 2019/0201073 | A1 | 7/2019 | Nott et al. | |
| 2019/0201075 | A1 | 7/2019 | Shelton, IV et al. | |
| 2019/0209022 | A1 | 7/2019 | Sobol et al. | |
| 2019/0274716 | A1 | 9/2019 | Nott et al. | |
| 2019/0387998 | A1 | 12/2019 | Garten et al. | |
| 2020/0044592 | A1 | 2/2020 | Li et al. | |
| 2020/0100825 | A1 | 4/2020 | Henderson et al. | |
| 2020/0227983 | A1 | 7/2020 | Zhou et al. | |
| 2020/0242471 | A1 | 7/2020 | Busch | |
| 2020/0294374 | A1 | 9/2020 | Falkenberg et al. | |
| 2020/0322703 | A1 | 10/2020 | Bures et al. | |
| 2020/0383265 | A1 | 12/2020 | Holgersson | |
| 2021/0307652 | A1 | 10/2021 | Lari et al. | |
| 2021/0310811 | A1 | 10/2021 | Oosugi et al. | |
| 2021/0311133 | A1 | 10/2021 | Oosugi et al. | |
| 2021/0319894 | A1 | 10/2021 | Sobol et al. | |

FOREIGN PATENT DOCUMENTS

| | | | | |
|---|---|---|---|---|
| CN | 206239547 | U | 6/2017 | |
| CN | 107423669 | A | 12/2017 | |
| CN | 107550584 | A | 1/2018 | |
| CN | 104207755 | B | 6/2018 | |
| CN | 104287703 | B | 6/2018 | |
| CN | 106215405 | B | 7/2018 | |
| CN | 106333667 | B | 7/2019 | |
| CN | 110621445 | A | 12/2019 | |
| CN | 111093891 | A | 5/2020 | |
| CN | 105433949 | B | 6/2020 | |
| CN | 111526816 | A | 8/2020 | |
| CN | 111526819 | A | 8/2020 | |
| CN | 111526820 | A | 8/2020 | |
| CN | 111526821 | A | 8/2020 | |
| CN | 111565658 | A | 8/2020 | |
| CN | 111601562 | A | 8/2020 | |
| CN | 111601564 | A | 8/2020 | |
| CN | 111801883 | A | 10/2020 | |
| CN | 112041687 | A | 12/2020 | |
| CN | 112106153 | A | 12/2020 | |
| CN | 112825468 | A | 5/2021 | |
| CN | 113710424 | A | 11/2021 | |
| CN | 113852364 | A | 12/2021 | |
| DE | 1473486 | A1 | 4/1969 | |
| DE | 102015223743 | A1 | 11/2016 | |
| EP | 0018626 | A1 | 11/1980 | |
| EP | 0366719 | B1 | 1/1994 | |
| EP | 2410650 | A2 | 1/2012 | |
| EP | 3375571 | A2 | 9/2018 | |
| EP | 3175139 | B1 | 5/2019 | |
| EP | 3694408 | A1 | 8/2020 | |
| EP | 3792717 | A1 | 3/2021 | |
| EP | 3082115 | B1 | 6/2021 | |
| EP | 3371048 | B1 | 8/2021 | |
| EP | 3868128 | A2 | 8/2021 | |
| EP | 3916999 | A1 | 12/2021 | |
| JP | 2003189661 | A | 7/2003 | |
| JP | 3501016 | B2 | 2/2004 | |
| JP | 3744781 | B2 | 2/2006 | |
| JP | 2009245552 | A | 10/2009 | |
| JP | 4835161 | B2 | 12/2011 | |
| JP | 4885068 | B2 | 2/2012 | |
| JP | 5293163 | B2 | 9/2013 | |
| JP | 2014512876 | A | 5/2014 | |
| JP | 5545333 | B2 | 7/2014 | |
| JP | 2015505694 | A | 2/2015 | |
| JP | 5948021 | B2 | 7/2016 | |
| JP | 2019503782 | A | 2/2019 | |
| JP | 2020048384 | A | 3/2020 | |
| JP | 6709281 | B2 | 6/2020 | |
| JP | 6749455 | B2 | 9/2020 | |
| JP | 2021027766 | A | 2/2021 | |
| JP | 2021083294 | A | 5/2021 | |
| KR | 20050062773 | A | 6/2005 | |
| KR | 101653558 | B1 | 9/2016 | |
| KR | 20180103903 | A | 9/2018 | |
| KR | 20200026798 | A | 3/2020 | |
| MY | 159877 | A | 2/2017 | |
| WO | 2001078216 | A1 | 10/2001 | |
| WO | 2003052793 | A2 | 6/2003 | |
| WO | 2004066482 | A2 | 8/2004 | |
| WO | 2008127316 | A1 | 10/2008 | |
| WO | 2011100412 | A2 | 8/2011 | |
| WO | 2015157487 | A1 | 10/2015 | |
| WO | WO-2016015697 | A1 * | 2/2016 | H02J 17/00 |
| WO | WO-2016180929 | A1 * | 11/2016 | A46B 15/0002 |
| WO | 2017112778 | A1 | 6/2017 | |
| WO | 2017151459 | A1 | 9/2017 | |
| WO | 2017197308 | A1 | 11/2017 | |
| WO | 2018035499 | A2 | 2/2018 | |
| WO | 2018050125 | A1 | 3/2018 | |
| WO | 2018053680 | A1 | 3/2018 | |
| WO | 2018065373 | A1 | 4/2018 | |
| WO | 2019084807 | A1 | 5/2019 | |
| WO | 2019089371 | A2 | 5/2019 | |
| WO | 2019094440 | A1 | 5/2019 | |
| WO | 2019173768 | A1 | 9/2019 | |

(56) References Cited

FOREIGN PATENT DOCUMENTS

| | | | |
|---|---|---|---|
| WO | 2019183412 | A1 | 9/2019 |
| WO | 2020026513 | A1 | 2/2020 |
| WO | 2020026514 | A1 | 2/2020 |
| WO | 2020028157 | A1 | 2/2020 |
| WO | 2020030468 | A1 | 2/2020 |
| WO | 2020031882 | A1 | 2/2020 |
| WO | 2020031937 | A1 | 2/2020 |
| WO | 2020031938 | A1 | 2/2020 |
| WO | 2020031942 | A1 | 2/2020 |
| WO | 2020031943 | A1 | 2/2020 |
| WO | 2020058031 | A1 | 3/2020 |
| WO | 2020167430 | A2 | 8/2020 |
| WO | 2020193083 | A1 | 10/2020 |
| WO | 2020219802 | A1 | 10/2020 |
| WO | 2020257555 | A1 | 12/2020 |
| WO | 2020261764 | A1 | 12/2020 |
| WO | 2021018538 | A1 | 2/2021 |
| WO | 2021018539 | A1 | 2/2021 |
| WO | 2021069208 | A1 | 4/2021 |
| WO | 2021069209 | A1 | 4/2021 |
| WO | 2021100844 | A1 | 5/2021 |
| WO | 2022001022 | A1 | 1/2022 |
| WO | 2022004092 | A1 | 1/2022 |

OTHER PUBLICATIONS

Kim, K. et al., "Interactive toothbrushing education by a smart toothbrush system via 3D visualization", Computer Methods Programs in Biomed., Nov. 2009, pp. 125-132, vol. 96, No. 2.

Walji, M. et al., "A persuasive toothbrush to enhance oral hygiene adherence", AMIA Annu Symp Proc., Nov. 6, 2008, p. 1167.

Baszynski, M. et al., "3D posture measurements in dental applications", International Symposium on Virtual and Intelligent Measurement Systems, May 2002, pp. 51-55.

Hope, C., "In vitro assessment of the plaque-removing ability of hydrodynamic shear forces produced beyond the bristles by 2 electric toothbrushes", J Periodontol, Jul. 2003, pp. 1017-1022, vol. 74, No. 7.

Hope, C., "Effects of dynamic fluid activity from an electric toothbrush on in vitro oral biofilms", J Clin Periodontol, Jul. 2003, pp. 624-629, vol. 30, No. 7.

Marini, I. et al., "Combined effects of repeated oral hygiene motivation and type of toothbrush on orthodontic patients: a blind randomized clinical trial", Angle Orthod., Sep. 2014, pp. 896-901, vol. 84, No. 5.

International Search Report dated Sep. 3, 2020 issued in PCT/US2020/038594.

* cited by examiner

| Roll Angle | Surface List |
|---|---|
| up | LUC, RUC, FUI |
| down | LLC, RLC, FLI |
| right | LLO, LUO, RLI, RUI |
| left | LLI, LUI, RUO, RLO |

(a) Aggressive Brushing (b) Normal Brushing (a) Tracking Error (b) Roll Angle Estimation

SYSTEM AND METHOD FOR TOOTHBRUSH MONITORING USING MAGNETO-INDUCTIVE COIL SENSOR

CROSS REFERENCE TO RELATED APPLICATION

This application claims the benefits of U.S. Provisional Patent Application Ser. No. 62/864,858, filed Jun. 21, 2019, the entire contents and disclosure of which are hereby incorporated herein by reference.

BACKGROUND

This disclosure generally relates to human behavior (activity, movement, gesture and the like) tracking, recognition and analysis. More specifically, this disclosure relates to a method and system for tracking, recognizing and analyzing tooth brushing activities and selectively modifying tooth brushing activities to improve a user's compliance of tooth brushing techniques recommended by dental professionals and to improve the user's oral hygiene results.

As one of the most widely used home oral hygiene devices, a typical electric toothbrush (ET) uses a motor to generate rapid automatic bristle motions that can effectively remove plaque, reduce gingivitis, and prevent tooth decay and gum diseases. However, many users still develop dental problems even after using electric toothbrushes on a daily basis, and some users even experienced receding and bleeding gums, eroded enamel, and fillings falling out. This is because the uses make certain common mistakes, such as, failure to brush surfaces of some teeth, brushing with incorrect techniques, and brushing for insufficient or excessive time. The automatic detection of improper brushing habits can significantly improve the user's oral hygiene results.

Existing ET monitoring systems have employed a variety of sensors, including camera, microphone, and inertial sensors. The most advanced Oral-B GENIUS 7000 model uses a mounted smartphone camera to detect which one of the four quadrants that a user is brushing. Nevertheless, it cannot tell which surfaces are being brushed within a tooth quadrant, not to mention the insufficient or over brushing, because the camera cannot see inside the user's mouth. Moreover, the camera-based approach does not work in low light conditions and often raises privacy concerns. Some other systems like Philips and Kolibree rely on inertial sensors to detect brushing areas. However, solutions based on inertial sensor usually suffer from low recognition accuracy due to drifting errors, and experiments showed that the strong ET vibrations significantly aggravate the drifting errors of positioning based on Inertial Measurement Units (IMUs). Similarly, previous research on manual tooth brushing monitoring using motion features does not work for ET due to its significant motion noise.

Thus, the known sensing technologies all have intrinsic limitations. Therefore, it is desirable to build a monitoring system that monitors finer-grained surface coverage and incorrect brushing techniques reliably.

SUMMARY OF THE INVENTION

According to an aspect of the present disclosure, a system for monitoring and analyzing activities of a user operating a hand tool having an electric motor is provided. The hand tool is movable by the user to process a predetermined target area having a plurality of surfaces. The system includes a magneto-inductive sensor array being configured to detect a magnetic field induced by motions of the electric motor. The magneto-inductive sensor array is further configured to generate a plurality of signals each having a signal strength representative of a strength of the magnetic field and a signal waveform representative of a waveform of the magnetic field. The system further includes a hardware process. The hardware processor is configured to receive the plurality of signal, determine a position of the hand tool by applying the signal strengths to a motor magnetic model, and determine a roll angle of the hand tool by applying the signal waveforms to a signal waveform model. The hardware processor is further configured to determine a surface of the plurality of surfaces of the predetermined target area based on the position and the roll angle of the hand tool, wherein the surface is being processed by the hand tool.

According to an embodiment, the magneto-inductive sensor array includes at least five magnetic induction coils.

According to an embodiment, the plurality of magnetic induction coils includes eight magnetic induction coils arranged in a matrix of 2×4.

According to an embodiment, the position determined by the motor magnetic model is defined by a distance along the x axis, a distance along the y axis, a distance along the z axis, a yaw angle and a pitch angle.

According to an embodiment, the hardware processor is further configured to: determine whether there are periodic repetitive motions of the hand tool along the x axis based on the position and the roll angle of the hand tool; and generate an alarm signal based on a determination that there are periodic repetitive motions of the hand tool along the x axis.

According to an embodiment, the hardware processor is further configured to: determine whether each surface of the plurality of surfaces of the predetermined target area has been processed by the hand tool; and generate a completion signal based on a determination that each surface of the plurality of surfaces of the predetermined target area has been processed by the hand tool.

According to an embodiment, the hardware processor is further configured to: determine a period of time, during which the surface of the plurality of surfaces of the predetermined target area is being processed by the hand tool; and generate an alarm signal based on a determination that the period of time is not within a predetermined range.

According to an embodiment, the hand tool includes an electric toothbrush and the predetermined target area includes the teeth of the user having sixteen brushing surfaces. The hardware process is configured to: determine a position of the electric toothbrush; determine a roll angle of the electric toothbrush; and determine a surface of the sixteen brushing surfaces of the teeth, wherein the surface is being cleaned by the electric toothbrush.

According to an aspect of the present disclosure, a method for monitoring and analyzing activities of a user operating a hand tool having an electric motor is provided. The hand tool is movable by the user to process a predetermined target area having a plurality of surfaces. The method includes: receiving a plurality of signals each having a signal strength and a signal wave form, wherein the signal strength is representative of a strength of a magnetic field induced by motions of the electric motor, wherein the signal waveform representative of a waveform of the magnetic field; determining a position of the hand tool by applying the signal strengths to a motor magnetic model; determining a roll angle of the hand tool by applying the signal waveforms to a signal waveform model; and determining a surface of the plurality of surfaces of the predetermined target area based on the position and the roll angle of the hand tool, wherein the surface is being processed by the hand tool.

According to an embodiment, the position determined by the motor magnetic model is defined by a distance along the x axis, a distance along the y axis, a distance along the z axis, a yaw angle and a pitch angle.

According to an embodiment, the method further includes: determining whether there are periodic repetitive motions of the hand tool along the x axis based on the position and the roll angle of the hand tool; and generating an alarm signal based on a determination that there are periodic repetitive motions of the hand tool along the x axis.

According to an embodiment, the method further includes: determining whether each surface of the plurality of surfaces of the predetermined target area has been processed by the hand tool; and generating a completion signal based on a determination that each surface of the plurality of surfaces of the predetermined target area has been processed by the hand tool.

According to an embodiment, the method further includes: determining a period of time, during which the surface of the plurality of surfaces of the predetermined target area is being processed by the hand tool; and generating an alarm signal based on a determination that the period of time is not within a predetermined range.

According to an embodiment, the hand tool includes an electric toothbrush and the predetermined target area includes the teeth of the user having sixteen brushing surfaces. The method includes: determining a position of the electric toothbrush; determining a roll angle of the electric toothbrush; and determining a surface of the sixteen brushing surfaces of the teeth, wherein the surface is being cleaned by the electric toothbrush.

According to an aspect of the present disclosure, a computer program product for use with a computer is provided. The computer program product includes a computer readable storage medium having recorded thereon a computer-executable program for causing the computer to perform a process for monitoring and analyzing activities of a user operating a hand tool having an electric motor. The process includes: receiving a plurality of signals each having a signal strength and a signal wave form, wherein the signal strength is representative of a strength of a magnetic field induced by motions of the electric motor, wherein the signal waveform representative of a waveform of the magnetic field; determining a position of the hand tool by applying the signal strengths to a motor magnetic model; determining a roll angle of the hand tool by applying the signal waveforms to a signal waveform model; and determining a surface of the plurality of surfaces of the predetermined target area based on the position and the roll angle of the hand tool, wherein the surface is being processed by the hand tool.

According to an embodiment, the position determined by the motor magnetic model is defined by a distance along the x axis, a distance along the y axis, a distance along the z axis, a yaw angle and a pitch angle.

According to an embodiment, the process further includes: determining whether there are periodic repetitive motions of the hand tool along the x axis based on the position and the roll angle of the hand tool; and generating an alarm signal based on a determination that there are periodic repetitive motions of the hand tool along the x axis.

According to an embodiment, the process further includes: determining whether each surface of the plurality of surfaces of the predetermined target area has been processed by the hand tool; and generating a completion signal based on a determination that each surface of the plurality of surfaces of the predetermined target area has been processed by the hand tool.

According to an embodiment, the process further includes: determining a period of time, during which the surface of the plurality of surfaces of the predetermined target area is being processed by the hand tool; and generating an alarm signal based on a determination that the period of time is not within a predetermined range.

According to an embodiment, the hand tool includes an electric toothbrush and the predetermined target area includes the teeth of the user having sixteen brushing surfaces. The process includes: determining a position of the electric toothbrush; determining a roll angle of the electric toothbrush; and determining a surface of the sixteen brushing surfaces of the teeth, wherein the surface is being cleaned by the electric toothbrush.

DETAILED DESCRIPTION

Detailed embodiments of the system and method of the present disclosure are described herein; however, it is to be understood that the disclosed embodiments are merely illustrative of the disclosed systems and methods that may be embodied in various forms. In addition, each of the examples given in connection with the various embodiments of the disclosure are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the methods and structures of the present disclosure.

Figure 1:
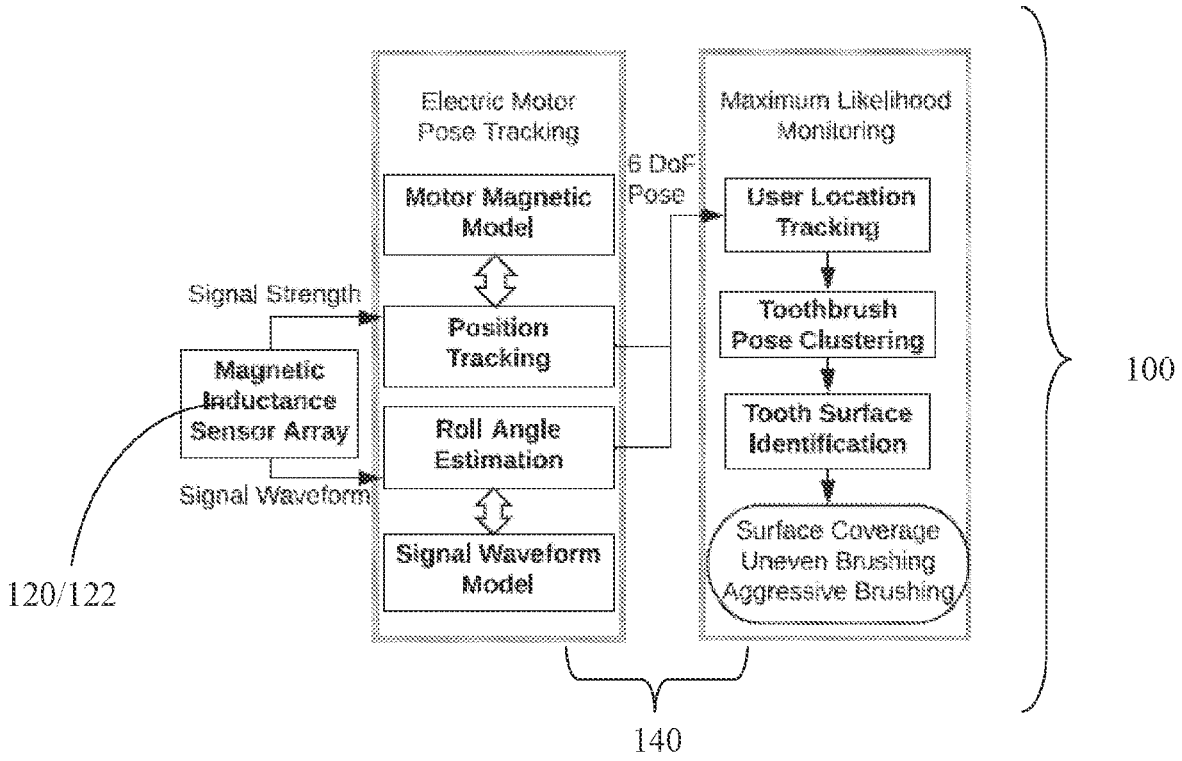
FIG. 1 is a schematic diagram showing a system for monitoring and analyzing activities of a user operating an electric toothbrush having an electric motor, according to an embodiment of the present disclosure.

FIG. 1 is a block diagram showing a system 100 on which, or with which, embodiments of the present disclosure can be implemented. The system 100 is capable of monitoring and analyzing activities of a person operating a hand tool having an electric motor. The hand tool is operated by the person to process a predetermined target area that includes a plurality of surfaces.

In the shown embodiments, the hand tool is an electric toothbrush as commonly accessible from the market; the predetermined target area is the teeth of the user having sixteen brushing surfaces. The person is a user of the electric toothbrush for brushing the sixteen brushing surfaces of the teeth of the user. However, the system is not limited to monitoring and analyzing tooth brushing activities of a person. For example, the system can be equally applied to monitor and analyze other activities (such as, exercising, eating and so on) of a person in an effort to ensure that moving trajectories of a predetermined body part of the person during the activities comply with guidelines.

The system 100 includes a magneto-inductive sensor array 120 and a hardware processor 140 in communication with the magneto-inductive sensor array 120. The magneto-inductive sensor array 120 is configured to detect a magnetic field induced by motions of the electric motor of the hand tool and subsequently, generate a plurality of signals based on the detected magnetic field. Each signal has a signal strength representative of a strength of the magnetic field and a signal waveform representative of a waveform of the magnetic field.

The magneto-inductive sensor array 120 can be a customized magneto-inductive sensor array for measuring the motor magnetic field. For example, a market available Oral-B genius 7000 generates a magnetic field with a strength that ranges from approximately 5 nT ($10^{-9}$) to 1 μT ($10^{-6}$), and the primary harmonic of the time-varying magnetic field is about 1000 Hz. In a typical home environment, there is a constant background magnetic field that ranges from about 50 μT to hundreds of μT. Thus, it is challenging to sense the electric toothbrush motor magnetic fields in a high-fidelity, reliable, and low-cost way. The customized magneto-inductive sensor array according to this disclosure is capable of achieving a nT-level of sensing resolution, with a sufficient sensing bandwidth (>2000 Hz).

The motor magnetic field has a strength of around 5 nT at a distance of 50 cm, and a much stronger strengths of around several μT at a close distance. The main harmonics of the magnetic signals is around 1000 Hz. Different sensor options have been experimented to capture this signal. The Hall-effect sensor, which is low-cost and widely available in mobile devices, does not meet the sensing requirements because it cannot detect fields weaker than 0.1 μT. Low-end magneto-resistive sensors, such as the KMI25/2, have a sensing dynamic range of less than 188 μT and high sensitivity to temperature changes. As a result, ordinary magnetic materials, such as a metal shelf or jewelry, can cause the sensor to saturate. High-end magneto-resistive sensors, such as HMC1001, can meet the sensing requirements, yet they have high costs of above $30 each. The fluxgate sensor has a similar sensing capability to the magnetic inductance sensor, and the main difference is that the fluxgate sensor can monitor the DC component of the magnetic field. Since in monitoring electric tooth brushing, the time-varying component of the magnetic field is focused, the low-cost ($1<), flexible, highly-sensitive and reliable inductive sensor are adopted by the system 100.

Figure 2:
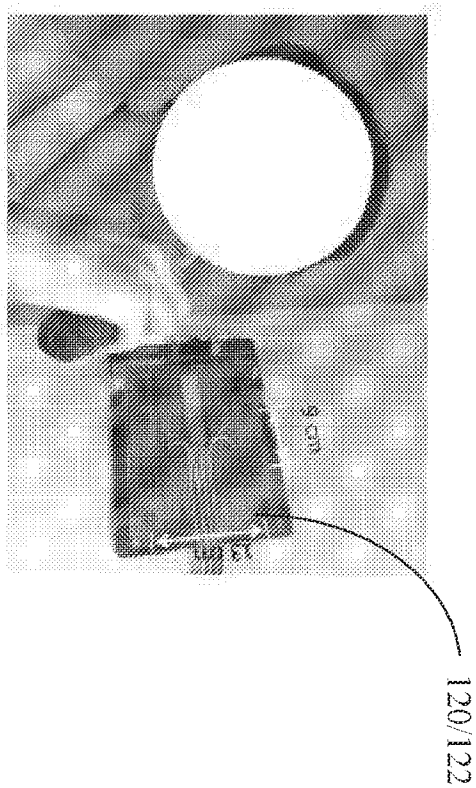
FIG. 2 is a schematic view of a magneto-inductive sensor array of the system.

According to Faraday's law, the induced voltage in an inductance sensor is linearly proportional to the cross-section area of the coil and quadratic to the number of rounds. Furthermore, a ferromagnetic core can increase the induced voltage by 100 folds. As a trade-off between the size of the sensor and the sensing sensitivity, sensor coils with 3000 rounds and 3 $cm^2$ cross-section areas, with a ferromagnetic core, can be used for the magneto-inductive sensor array 120. For example, the magneto-inductive sensor array 120 can include a plurality magnetic induction coils 122, such as, at least five magnetic induction coils. In the shown embodiment, the plurality magnetic induction coils 122 include eight magnetic induction coils arranged in a matrix of 2×4. FIG. 2 is a schematic view of the magneto-inductive sensor array 120 and eight magnetic induction coils 122 arranged in a matrix of 2×4. As shown, the user is holding an electric toothbrush for brushing the teeth of the user. The magneto-inductive sensor array 120 (including the eight magnetic induction coils) is disposed on a surface of a wall, which is in proximity of the user. The magneto-inductive sensor array 120 is provided on a circuit board. The distance between the top row and the bottom row of the magnetic induction coils can be set to about 13 cm and the distance between the middle two magnetic induction coils in each row can be set to about 9 cm.

Figure 3:
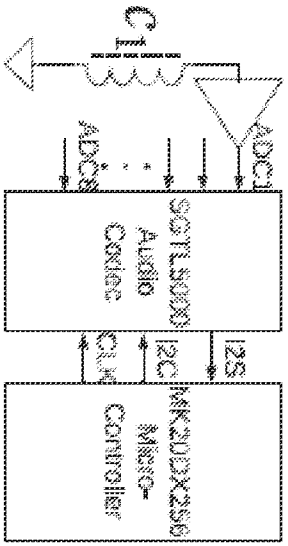
FIG. 3 is a circuit diagram of the system having the magneto-inductive sensor array.

FIG. 3 is a circuit diagram of the system 100 having the magneto-inductive sensor array 120. To amplify the received magnetic signal, a low-noise MAX4466 amplifier, with amplification gain up to 60 db, can be adopted. The multi-channel signals are digitized simultaneously using the 16 bits ADC on SGTL5000 chips and transmitted to two MK20DX256 micro-controllers using the I2S protocol. The system 100 can be powered by a USB cable connected to a computer. Since many electric toothbrushes are recharged by chargers connected to the electrical outlets, this disclosure also encompasses powering the system 100 by using an electric toothbrush charger. The SGTL5000 chip costs $1.27 each and four chips can be used by the system 100. The MK20DX256 micro-controllers costs $3.07 each and two micro-controllers can be used by the system 100. The MAX4466 amplifier cost $0.24 each and eight amplifiers can be used by the system 100.

The hardware processor 140 can be a processing unit or computer and may be controlled primarily by computer readable instructions, which may be in the form of software. For example, the hardware processor 140 can be embedded into a smart device, such as, a smart phone or a smart watch used by the user. The hardware processor 140 can be configured, adapted or programmed to implement certain calculations and/or functions, by executing the computer readable instructions.

In operation, the hardware processor 140 is configured to receive the signals generated by the magneto-inductive sensor array; determine a position of the hand tool by applying the signal strength to a motor magnetic model; and determine a roll angle of the hand tool by applying the signal waveform to a signal waveform model. Subsequently, the hardware processor 140 is configured to determine a surface of the plurality of surfaces of the predetermined target area based on the position and the roll angle of the hand tool. This surface is being processed by the hand tool.

In the context of the hand tool being an electric toothbrush and the target area being the teeth of the user having sixteen brushing surfaces, the hardware process is configured to: determine a position of the electric toothbrush; determine a roll angle of the electric toothbrush; and determine a brushing surface being cleaned by the electric toothbrush. For example, the tooth brush has a brush head provided with bristles and the position and/or orientation of the bristles are determined during the operation.

Figure 4:
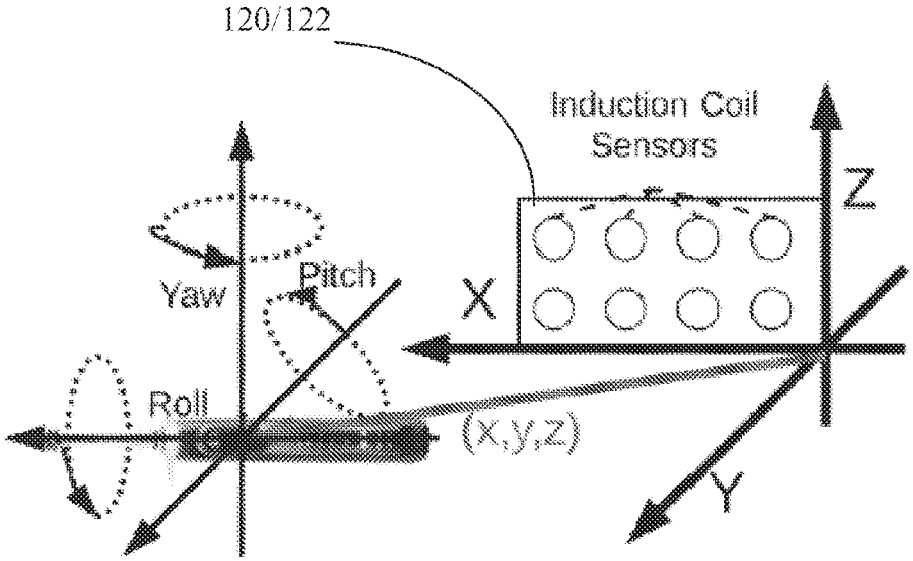
FIG. 4 is a schematic view showing a coordinate system applied with the system.

The position determined by the motor magnetic model is defined by a distance along an x axis, a distance along a y axis, a distance along a z axis, a yaw angle and a pitch angle. FIG. 4 is a schematic view showing a coordinate system applied with the system 100.

As shown in FIG. 4, the magneto-inductive sensor array 120 is mounted, for example, near the sink on one side of the user at an appropriate height, based on a common assumption that the user conducts a tooth brushing session over a sink for rinsing and cleaning to prevent drooling, which is recommended for electric tooth brushing in general. The system 100 does not require any training from its users, because all the tracking and recognition algorithms and/or models can be calibrated and trained before usage. The system 100 alerts its user in real-time when it detects over-brushing or the vigorous back-and-forth brushing technique. By the end of each brushing session, it reminds the user if the user forgets to (or insufficiently) brush any of the sixteen surfaces of teeth. It also generates a post-brushing report with detailed information on the brushing surface sequence and duration. Such monitoring functions are useful for general users. Moreover, dentists can provide personalized brushing recommendations to the patients, and the patients want to know if their tooth brushing is adequate and correct while they are at home. Children and teens, who need training and real-time assistant to develop good tooth brushing habits, can also benefit from it.

To monitor tooth brushing, it is essential to track both its position and orientation. To describe the pose of a toothbrush, the coordinate system as shown in FIG. 4 is introduced. The Z axis is pointing vertically up, the Y axis points to the right of the user, and the X axis points towards the user. The 3 Degrees of Freedoms (DoF) orientation of the toothbrush is described using the Tait-Bryan convention. The initial orientation of the toothbrush is parallel to the X axis. Any orientation can be obtained by consecutively rotating the toothbrush around X axis (roll), around Y axis (pitch), and around Z axis (yaw).

Figure 5:
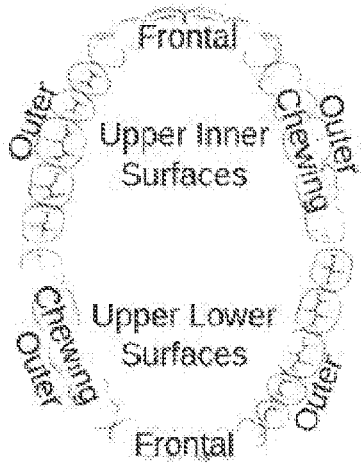
FIG. 5 is a schematic view showing the sixteen brushing surfaces of the teeth of the user.

FIG. 5 is a schematic view showing the sixteen brushing surfaces of the teeth of the user. Specifically, the user's left lower teeth include Left Lower Outer (LLO), Left Lower Chewing (LLC), and Left Lower Inner (LLI) surfaces. Similarly, the user's left upper side, right lower side and right upper side also include outer, chewing, and inner surfaces. For the user's front teeth, there are Front Lower Inner (FLI), Front Upper Inner (FUI), and Front Outer surfaces (FO).

Referring back to FIG. 1, the system 100 uses the magnetic field strength information to track the motor position of the hand tool (particularly, the motor position of the electric toothbrush) and the magnetic field waveform information to track the roll angle of the motor. The motor magnetic field is generated by its internal rotor, which contains three poles and each functions as an electric magnet with time-varying position, orientation, and magnetic strengths. In order to model this field to support motor position tracking, an approximate analytic model of the magnetic field strength and a data-driven statistical model of the magnetic field waveform are developed according this disclosure. A mathematical relationship between the motor position and the magnetic field strength at the sensor array 120 is established. The known technology has employed the Finite Element Method (FEM) to model the motor magnetic field. However, the known technology only focus on analyzing the magnetic fields inside of the motor, not the magnetic field in the open space, which is pertinent to the motor pose tracking. Furthermore, the FEM technique requires detailed parameters of the motor, such as the strength of the internal magnets and the permeability of the electromagnet cores. Such proprietary information is not available for the DC motor in an electric toothbrush due to the private implementation. The FEM is also compute-intensive, which makes it difficult to achieve real-time monitoring in use. According to this disclosure, an approximate motor magnetic model with sufficient accuracy but with significantly lower computation complexity than the FEM model is constructed. In particular, the motor is modeled as a point magnetic source with a time-varying magnetic moment and the model is validated with empirical data. This model enables a tracking algorithm for the 5 DoF pose of the motor, i.e., 3D position, and pitch and yaw angles.

Subsequently, the magnetic field waveform is used to determine the roll angle of the motor. The toothbrush roll angle is critical information for differentiating brushing surfaces. However, the change of roll angle has little impact on the magnetic field strength. To track an object's orientation using magnetic sensing, the known technology typically requires attaching additional magnetic field sources, such as a regular-shaped magnetic tag or magnetic coils with sinusoidal currents. In contrast, in the system 100, the electric toothbrush is not modified, which makes the electric toothbrush more user friendly. The magnetic field signal waveforms have subtle changes according to the roll angle. Based on this observation, a new machine learning algorithm is developed accruing to this disclosure, which achieves a coarse-grained toothbrush roll angle estimation using the magnetic signal waveform measurement data from multiple sensor coils.

Based on the toothbrush pose tracking and even with the 6 DoF pose tracking, it is still desirable to recognize each brushing surface and detect various brushing mistakes. The primary challenge is that a user is not standing still during brushing. The user can stand at different locations near a sink on different days. During each brushing session, the user can change brushing gestures, turn head, and even walk around slightly, while the tooth surfaces still maintain their relative positions regardless of the user movements. The relative positions of the teeth can be analyzed and described using a tooth map. Subsequently, an Expectation-Maximization algorithm that iteratively estimates the most likely brushing surface is developed, and a Hidden Markov Model (HMM) algorithm that estimates the user's most-likely movements is also developed.

As described previously, the hardware processor 140 is configured to determine a position of the hand tool by applying the signal strength to a motor magnetic model. The motor magnetic model is capable of estimating the magnetic field distribution around the motor. Using this model, a positioning algorithm is developed to track the 5 DoF pose based on magnetic sensor measurements.

Figure 6:
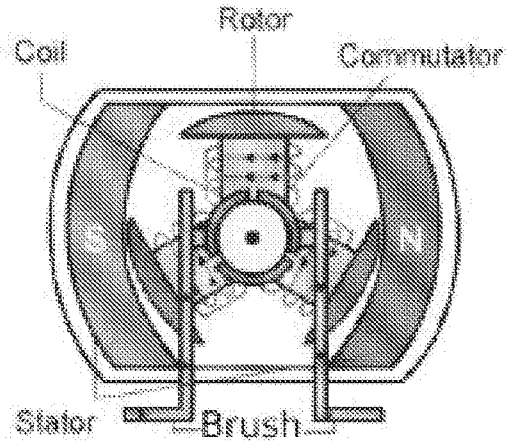
FIG. 6 is a schematic structural view of the motor of the electric toothbrush.

A market available Oral-B 7000 ET relies on a brushed direct current (DC) motor to generate high-speed rotary motions. The DC motors usually have private implementation, but the general structure is the same. FIG. 6 is a schematic structural view of a DC motor of the electric toothbrush. The DC motor includes two sectors of permanent magnets and a rotor. The rotor includes three poles, which generate magnetic field using the magnetic coils. Part of the rotor is a commutator that connects the coils to the electric brush. As the commutator rotates, its connection with the electric brush changes and reverses of the currents in the magnetic coils periodically. This process maintains a rotary torque with a constant direction. The periodic motions of the rotors and the switching of the electric brush generate a complex and discontinuous magnetic signal, whose main harmonic is correlated with the motor rotation rate.

Figure 7:
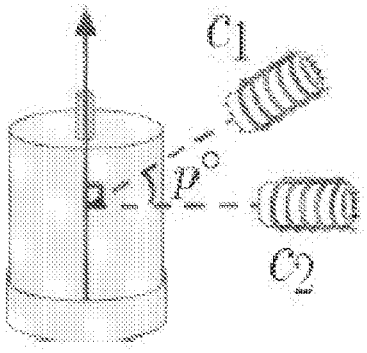
FIG. 7 is a schematic view showing an experimental setup for testing magnetic field generated by the motor of the electric toothbrush.

Experiments have been conducted to understand the magnetic field generated by a motor, and the experimental setup is illustrated in FIG. 7. In this setup, two magnetic sensors are disposed around an electric motor. The two sensors are in a plane perpendicular to the motor axis. The sensors have the same distance to the motor center, and are apart by an angle p. The magnetic signals are recorded when the angle p changes.

Figure 8:
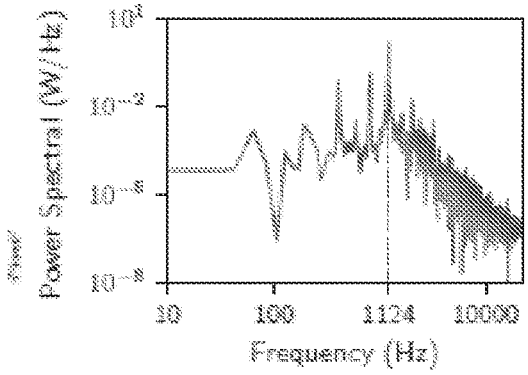
FIG. 8 is a schematic view showing the power spectral density of a sample magnetic signal.
Figure 9:
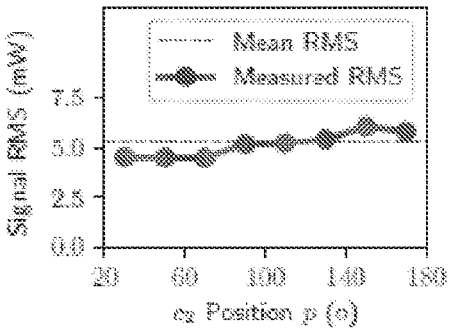
FIG. 9 is a schematic view showing a signal root mean square as coils of the system are placed at different angles.
Figure 10:
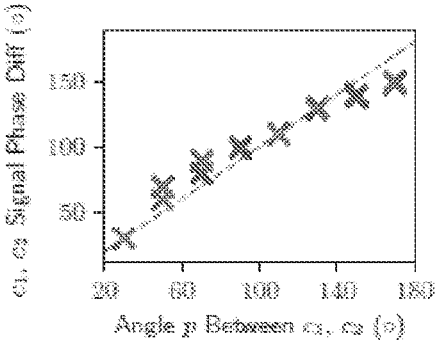
FIG. 10 is a schematic view showing a signal phase difference as the coils of the system are placed at different angles.

By analyzing the magnetic signals collected at different locations, it has been discovered that the signals are highly periodic, with a constant signal frequency. The power spectral density of a sample magnetic signal is plotted and shown in FIG. 8. As shown in FIG. 8, a large peak is at around the frequency of 1124 Hz. The signal strength of the coil $C_2$, measured by root mean square (RMS) when the coil $C_2$ is placed at different angles p. The recorded RMS, when the angle p changes, is plotted in FIG. 9. As shown in FIG. 9, the RMS remains stable, with only small fluctuations. Subsequently, the magnetic field signals simultaneously on both coil $C_1$ and $C_2$ when the angle p between the coils changes. The signal phase difference between the coils is computed by finding the peak value of the signal cross-correlation. The results of the signal phase difference are shown in FIG. 10. As shown, when the two coils are at an angle p apart, the signal phase difference is also approximately p.

For the motor magnetic model, s(p, t) is used to denote the sensor measurement collected at angle p at time t. The signal s(p, t) can be approximated using |M| cos(ωt−p). In particular, s(p, t) can be approximated by a sinusoidal function because the signal is highly periodic. The signal has a constant amplitude of MI because the signal has approximately the same magnitude regardless of the angle p. The signal has a phase of p because the signal phase difference is also approximately p. An embodiment of the model of the magnetic field source, which satisfies all the three above conditions, is shown as follows, based on the assumption that the motor axis is parallel to the x-axis.

$$M_0(t)=|M|[0,\cos\omega t,\sin\omega t]^T \tag{1}$$

The model defined by the above Equation 1 suggests that if the electric motor with a point magnet is replaced with a magnetic moment of M0(t), the magnetic sensors will still have similar measurements.

Based on the motor magnetic model described in Equation 1, a sensor measurement model can be deducted based on the magnetic field distribution equations. A mathematical model is developed, which can predict the measurements of a sensor when a motor changes its orientation (pitch β and yaw θ) and position [x, y, z], as shown in FIG. 4, based on the assumption that the position of the induction sensor, denoted by [a, b, c], is known.

Without loss of generality, it is assumed that the toothbrush's initial orientation is parallel to the positive direction of the x-axis, as shown in FIG. 4. Any orientations of the toothbrush can be obtained by rotating along the y and z axes. As shown in Equation 1, $M_0(t)$ is used to denote the magnetic moment of the toothbrush when it is at its initial orientation. Afterwards, the magnetic moment M(t, θ, β) can be obtained by using the rotation matrices Rz (θ) and Ry (β) that represent the yaw and pitch rotation.

$$M(t,\theta,\beta)=R_z(\theta)R_y(\beta)M_0(t), \tag{2}$$

$$R_z(\theta)=\begin{bmatrix}\cos\theta & -\sin\theta & 0\\ \sin\theta & \cos\theta & 0\\ 0 & 0 & 1\end{bmatrix},\ R_y(\beta)=\begin{bmatrix}\cos\beta & 0 & \sin\beta\\ 0 & 1 & 0\\ -\sin\beta & 0 & \cos\beta\end{bmatrix}$$

The relative position from the motor to the sensor is $r=[r_x, r_y, r_z]^T=[a-x, b-y, c-z]^T$. The magnetic field B at the sensor's position can be calculated using following equation:

$$B(r,M(t,\theta,\beta))=\frac{\mu}{4\pi|r|^3}\left[\frac{3rr^T}{|r|^2}-I_3\right]M(t,\theta,\beta). \tag{3}$$

According to Faraday's law of induction, the induced voltage v(t) at the induction coils sensor is linear to the derivative of the magnetic field. In the setting, all the induction coils are parallel to the Y axis, i.e., $s=[0, 1, 0]^T$. Substitute Equations 1, and 2 into Equation 3, the analytical expression of the received signal in an induction coil can be obtained, as shown in the following Equation 4.

$$\begin{aligned}
v(t)&=\mathrm{dB}(r,M(t,\theta,\beta))/dt\cdot s\\
&=\omega N_{RX}A_{RX}\mu_{RX}B(r,M(t,\theta,\beta))\cdot s\\
&=K[a_c(r,\theta,\beta)\cos(\omega t)+a_s(r,\theta,\beta)\sin(\omega t)]\\
a_c(r,\theta,\beta)&=[\cos(\theta)(2r_y^2-r_x^2-r_z^2)-3r_yr_z\sin(\theta)]/(r_x^2+r_y^2+r_z^2)^{2.5}\\
a_s(r,\theta,\beta)&=[\sin(\beta)\sin(\theta)(2r_y^2-r_x^2-r_z^2)+3r_xr_y\cos(\beta)+3r_yr_z\sin(\beta)\cos(\theta)]/(r_x^2+r_y^2+r_z^2)^{2.5}
\end{aligned} \tag{4}$$

In this equation, ω is the magnetic signal angular velocity. K is a constant determined by $N_{RX}$, $A_{RX}$ and $\mu_{RX}$, which represent the number of rounds, area, and the magnetic permeability of the induction coil, respectively. The expressions for $a_c$ (r, θ, β) and $a_s$ (r, θ, β) are also provided.

Figure 11:
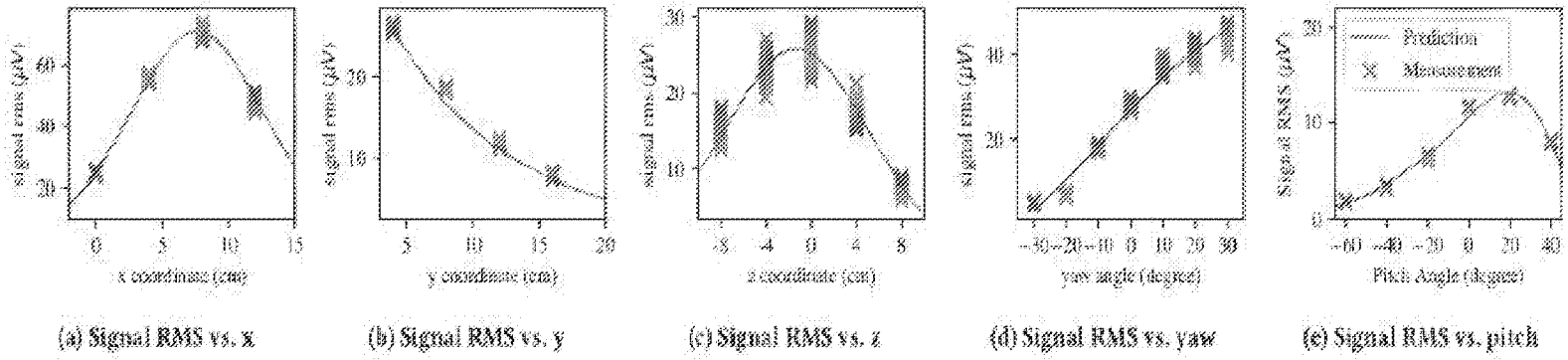
FIG. 11 is a schematic view showing certain sample measurement results.

According to equation 4, the RMS of the signal v(t) is linearly correlated with $\sqrt{a_c^2+a_s^2}$. Experiments have been conducted to validate this relation. The electric motor is placed at the locations with x coordinate ranges from [0, 12] cm, y ranges from [0, 8] cm, z ranges from [0, 8] cm, yaw angle from [−30°, 30°] and pitch angle ranges from [−60°, 40°]. Sample measurement results are shown in FIG. 11. The prediction of the model closely matches the actual sensor measurements. The $R^2$ value between the sensor measurements and the theoretical predictions of our model is 0.988, indicating the high accuracy of the model predictions, which validates the previous models.

The algorithm to track the motor's 5D pose X={x, y, z, β, θ} works as follows. In one embodiment, eight magnetic induction coils are provided, with each coil i installed at a known position $[a_i, b_i, c_i]^T$, at the same direction of $[0, 1, 0]^T$. At each time moment, the sensor array 120 records the signal RMS $v=[v_1, v_2, \ldots, v_8]$. The motor's 5 DoF pose is computed by solving the following optimization problem:

$$\min_X \; J = \sqrt{\sum_{i=1}^{8} |v_i' - v_i|^2} \tag{5}$$

$$\text{s.t.,} \quad v_i' = K\sqrt{a_c(r_i, \theta, \beta)^2 + a_s(r_i, \theta, \beta)^2}, \quad X_{min} \le X \le X_{max}.$$

Figure 12:
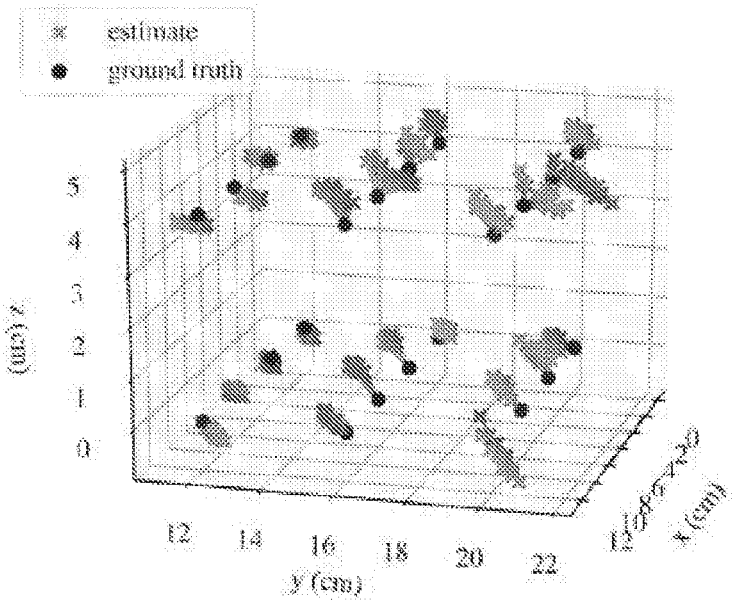
FIG. 12 is a schematic view of a plotted sample 3D position tracking result.

In this equation, $a_c(r_i, \theta, \beta)$ and $a_s(r_i, \theta, \beta)$ are defined in Equation 4. A standard optimizer is used to solve this optimization problem. A sample 3D position tracking results is plotted, as shown in FIG. 12. In FIG. 12, the dots represent the ground truth coordinates, while the crosses represent the estimated positions by the tracking algorithm of this disclosure. Thus, is evident that the tracking algorithm is capable of distinguishing different positions. Based on the position tracking result, the average tracking error is 2.9 cm and the 90% percentile tracking error is 4.1 cm.

To calibrate the positioning algorithm, it is needed to obtain parameters used in Equation 4, which include the position [a, b, c] and magnetic parameters ($N_{RX}$, $A_{RX}$, and $\mu_{RX}$), for each coil. While it is possible to measure these quantities directly, it is easier to estimate them indirectly. For example, the toothbrush needs to be placed at different known poses to obtain the sensor measurements. Afterwards, the maximum likelihood estimation technique is used, which estimates the parameters, such that the difference between the magnetic field prediction of the model and the actual measurement is minimized.

As illustrated in FIG. 4, the roll angle represents how the toothbrush rotates around its handle axis. The accurate monitoring of the toothbrush's roll angle is critical to reliable tooth brushing monitoring. For example, when brushing the left upper and lower chewing surfaces, the toothbrush has similar positions and pitch, yaw angles. The most effective way in distinguishing these two surfaces is by the roll angle: there is an 180° difference in the roll angle when the user is brushing upper or lower chewing surfaces. Based on experiments, it is discovered that the RMS of the magnetic field strength in the induction coil is insensitive to the changes in rolling angle. In addition, it is also discovered that when the electric motor has different roll angles, the captured signals have different waveforms in the time domain. Based on these findings, a signal signature based algorithm that can accurately recognize the roll angle of the electric motor.

Figure 13:
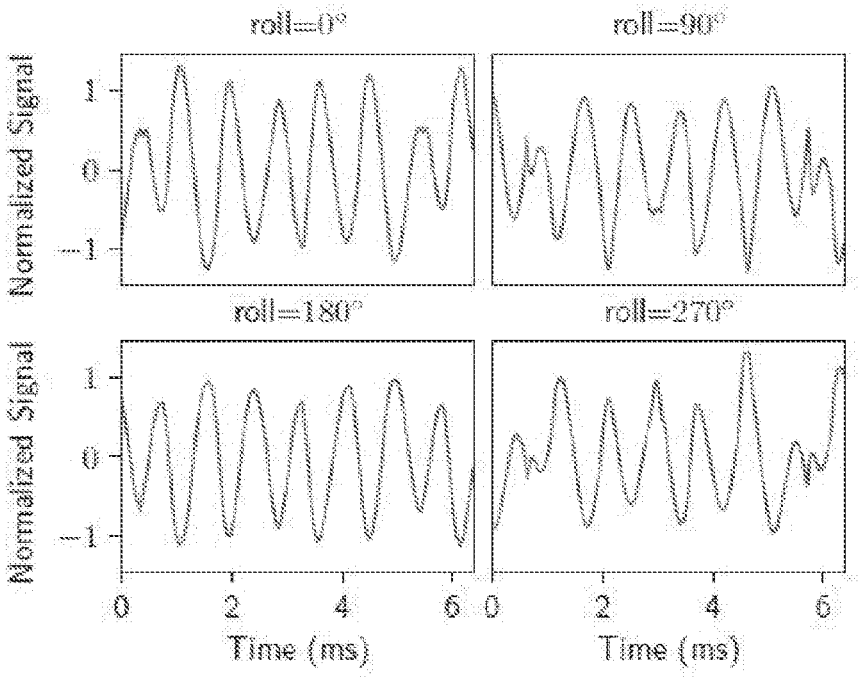
FIG. 13 is a schematic view showing different magnetic signal waveforms captured by a single coil.

Experiments have been conducted to investigate how the roll angle influences the signal waveforms. In these experiments, the roll angle is defined to be 0°, when the toothbrush faces the coil with the brush head, and the clock-wise rotation direction is set to be positive. The toothbrush is rotated and measurements at different roll angles are taken. FIG. 13 is a schematic view showing the different magnetic signal waveforms captured by a single induction coil. As show, when roll angles are 90° and 270°, the waveforms have small jitters that are reverse to each other at 1 and 6 millisecond, which is caused by the large current changes during the switching of the electric commutator. Moreover, the waveforms when roll angles are 0° and 180° are inverse to each other: when the upper signal has small peaks at 0.5 and 5 milliseconds, the lower signal has small valleys at the same moments.

Based on these unique signal characteristics and patterns generated by the motor, a collaborative sensing algorithm is designed to recognize the toothbrush roll angle. Since different sensor coils can collect different waveforms of the magnetic signal because they have different roll angles relative to the toothbrush, this algorithm needs to fuse sensing data from multiple coils to obtain the final roll angle recognition result. The electric motor roll angle recognition is described as follows. At each moment, the sensor array collects eight signal waveforms. Subsequently, a customized signal similarity measurement function is used to calculate the similarities between the collected signal waveforms and the template signal waveforms. These signal similarities measurements serve as inputs to a deep fully connected neural network to recognize the toothbrush roll angle.

First, a list of template signals $\{t_1, t_2, \ldots, t_M\}$ are collected, where $t_m$ represents the magnetic field signal collected by the sensor when the toothbrush has a roll angle of $r_m$. Since all the sensor coils have the same gains, the signal templates are collected from a single coil. At each moment, the sensor array collects a set of magnetic signals, represented by $\{s_i\}$(i=1, 2, . . . , 8). For each signal $s_i$, it similarities to the template signals $\{t_m\}$ is measured. To obtain a reliable and robust result, different signal transformation techniques are tested in time series classification, including Fourier transform domain, power spectrum domain, auto-correlation domain. Two signal similarity measures are finally selected. The first one is the cross-correlation between the signals ($d_o$ (•, •)), and the second one is the correlation between the signal derivatives ($d_d$ (•, •)). These two signal similarity measures are defined as follows:

$$d_o(s_i, t_m) = \max(\mathrm{corr}(s_i, t_m))$$

$$d_d(s_i, t_m) = \max(\mathrm{corr}(dir(s_i), dtr(t_m))), \tag{6}$$

The operator corr (•, •) represents the cross-correlation between two signals, which quantifies their similarities. The operator dir (•, •) represents taking derivative of the signal. In the embodiment, a bandpass filter centered around 1000 Hz to remove signal noises. By computing the similarities between different signals and templates, a feature set can be obtained. The feature set contains rich information about the toothbrush roll angle. However, the relationship between the feature and the toothbrush roll angle is nonlinear, and many classifiers cannot handle the complexity. According to the tests, the deep fully connected neural network achieves the best accuracy and robustness. This network contains four fully connected hidden layers with 32 neurons each. The output contains four classes of roll angles: left, right, up, and down. The classifier is trained by moving the toothbrush around with different roll angles to allow the sensors to collect the signals. This training process is conducted before system deployment by the developer so that no user participation is needed.

The brushing monitoring is based on the toothbrush pose tracking results. To improve user convenience, an unsupervised brushing surface recognition algorithm is designed based on the spatial distribution of 15 tooth surfaces. To improve the algorithm robustness to user movements, an HMM-based algorithm is also developed to track the user's motions.

The motor tracking algorithm monitors the poses of the electric motor. The motor poses can be used to compute the pose of the brush head using the following equation.

$$[x',y',z']=[x,y,z]+[l,0,0]*Ry(\beta)*R_z(\theta). \tag{7}$$

In Equation 7, l represents the distance between the brush head and the electric motor. Ry (β) and Rz (θ) are rotation matrices, which are defined in Equation 2.

The toothbrush pose tracking results are denoted as $X=\{X_1, \ldots, X_n\}$, where X includes the x', y', z' coordinates, and the roll angle of the toothbrush. The brushing surfaces m can be recognized based on the toothbrush poses X. First, a clustering of the toothbrush poses is conducted using the Expectation-Maximization algorithm (EM). Afterwards, the tooth surface corresponding to each cluster is identified by analyzing their spatial characteristics.

Figure 14:
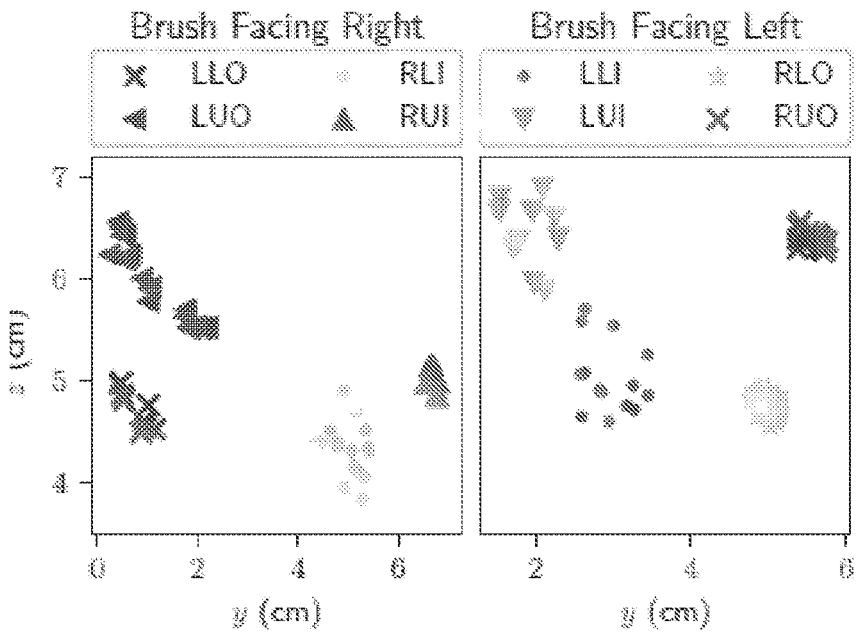
FIG. 14 is a schematic view showing positions of the brush head of the electric toothbrush for different brushing surfaces of the teeth of the user.

Due to the spatial distribution of the teeth, the toothbrush poses form distinct clusters when brushing different surfaces, as illustrated in FIG. 14. The distribution of the toothbrush poses is modeled within each cluster using a multivariate Gaussian distribution. A Shapiro-Wilk test is conducted, which is a classical approach to test the normality of data, on the data collected from five tooth brushing sessions. The mean p-value is 0.407, which is higher than the threshold value 0.05 that is needed to accept the normality assumption of data. In other words, $P(X|M_t)\sim N(\mu_m, \Sigma_m)^*$, where μ represents the mean of the brush head positions, and $\Sigma_m$ represents the covariance matrix. If the user is standing at location $S_T$ and brushing surface m, then P(X|St,m) is the following Gaussian distribution:

$$P(X|S_t, m) = \frac{\exp\left(-\frac{1}{2}(X-\mu_m-S_t)^T\sum_m^{-1}(X-\mu_m-S_t)\right)}{(2\pi)^{\frac{k}{2}}\det(\sum_m)^{\frac{1}{2}}}. \tag{8}$$

An EM-based algorithm is used for clustering. The expectation and maximization steps described in the following Equation 9 are repeated until convergence.

$$\text{Expectation:} P(m|X) = \frac{N\left(X\middle|\mu_m, \sum_m\right)}{\sum_k N\left(X\middle|\mu_k, \sum_k\right)} \tag{9}$$

$$\text{Maximization:}\quad \mu_m = \frac{\sum_n P(m|X_n)X_n}{\sum_n P(m|X_n)}, \quad \sum_m = \frac{\sum_n P(m|X_n)(X_n-\mu_m)(X_n-\mu_m)^T}{\sum_n P(m|X_n)}$$

Using this algorithm, the mean $\mu_m$ and covariance matrix $\Sigma_m$ for each cluster m. The probability P(m|X) is also obtained, which represents the likelihood for the head pose X to belong to a cluster m.

When a user turns her or his head during brushing, the positions of the tooth surfaces change accordingly. To maintain recognition accuracy, the user's tooth surface position after a head turn is estimated. The key observation is that when the user brushes the back teeth, the motion direction of the toothbrush is approximately the same as the user's facing direction. In particular, the vector d is used to represent the facing direction of the user's head, which is approximately equal to the primary axis of toothbrush motions. Therefore, for a cluster of toothbrush positions with a mean of $\mu_m$ and covariance matrix $\Sigma_m$, the facing direction d can be estimated by using the Principle Component Analysis (PCA), which is shown in the first line of the following Equation 10. Note that there are two feasible values for d, and the one that represents a smaller head turn angle is selected.

$$d_m \leftarrow \underset{d}{\operatorname{argmax}}\left(d^T\sum_m d/d^Td\right). \tag{10}$$
$$\mu'_m \leftarrow \mu_m - l*d_m/|d_m| + l*[-1, 0, 0]^T.$$

Afterwards, the position of the tooth surface when the user is facing front is estimated, i.e., the head is facing the direction of [−1, 0, 0], as illustrated in the coordinate system of FIG. 4. This is achieved in the second line of the above Equation 10. In this equation, l is the distance between the tooth surface and the user's neck and its value is empirically set to 10 cm. Subsequently, the cluster center $\mu'_m$ is used to conduct tooth surface identification.

The rules for tooth surface identification are set as follows. First, depending on the toothbrush roll angle, the clusters are divided into four categories: the toothbrush bristles can face up, down, left, and right. The tooth surfaces for each toothbrush bristle directions are shown in FIG. 5. Next, the surface identification rules for each toothbrush bristle orientation are described. When the toothbrush bristle faces up, there are three possible surfaces: Left Upper Chewing (LUC), Right Upper Chewing (RUC), and Front Upper Inner (FUI) (shown in FIG. 5). The y coordinates of the three clusters are compared. Since the y-axis points to the right of the user, the cluster with the largest y coordinate is identified as RUC, the one with the smallest is identified as LUC, and the other is identified as FUI. Using a similar rule, the surface labels when the toothbrush bristle is facing down can also be identified, i.e., the LLC, RLC, and FLI surfaces, as shown in FIG. 5. When the toothbrush bristle is facing right or left, cluster centers are computed to distinguish different surfaces, as illustrated in FIG. 14.

A user may walk around while brushing her or his teeth, and such walking motions can negatively impact brushing monitoring. To achieve robust surface recognition, it is important to distinguish a user's walking motions and the brushing motions. The key observation is that a user's walking motions usually have unique patterns, which can be used for its tracking. For example, significant changes of the toothbrush location are often caused by location changes of the user, because the regular toothbrush movements when a user stands still are all in very short distances (the distance between the left and right teeth and the distance between the back and front teeth of an adult are less than 5 cm for an adult). In addition, frequent movements in horizontal direction often indicate walking movements, because with brushing motions alone, the toothbrush's horizontal positions will concentrate in three small regions determined by the positions of the left, front and right teeth. To track the user's walking movements, the user's standing location is modeled as a hidden variable, and a Hidden Markov Model (HMM) based algorithm is developed to recognize the walking movements.

Each state St is defined as the 2D location of a user, as shown in the first row of the following Equation 11. The region in front of the sink is discretized, so that there are in total N different states. Since the initial standing location of the user is not known, the prior probability $\Pi(S_t)$ is set to be uniform, as shown in the second row of the following Equation 11. A uniform transition probability for the user is set to move to an adjacent or remain at the same location, as shown in the third row of the Equation 11. The notation $N(S_t)$ is used to represent all the states adjacent to $S_t$ and the state $S_t$ itself.

$$S_t = [x_s, y_s] \tag{11}$$

$$\prod(S_t) = 1/N$$

$$P(S_t|S_{t-1}) = \begin{cases} 1/|N(S_{t-1})| & \text{if } S_t \in N(S_{t-1}) \\ 0 & \text{otherwise} \end{cases}$$

As discussed previously, the toothbrush poses form a mixture of Gaussian Distributions when the user's standing location is given. The influence of the standing location is modeled as a translational shift. Therefore, the emission probability can be computed as follows:

$$P(X|S_t) = \sum_{m=1}^{K_m} P(X|S_t, m). \tag{12}$$

The definition of $P(X|S_t,m)$ is shown in Equation 8. Before tracking walking movements, it is assumed that the user brushes at least once without walking so that our system can estimate $P(X|S=0,m)$, $\mu_m$, and $\Sigma_m$ at the user's standing location. Afterwards, the emission probability can be generated by changing the value of S to the other standing locations. Based on this HMM formulation, the classical Viterbi algorithm can be used to find the most likely standing locations $\{S_1, S_2, \ldots, S_t\}$ based on the toothbrush pose measurements X. Subsequently, the first row (Expectation step) in Equation 9 is used to calculate the probability for $P(m|X)$. The most likely surface m is returned as the surface recognition result.

Figure 15:
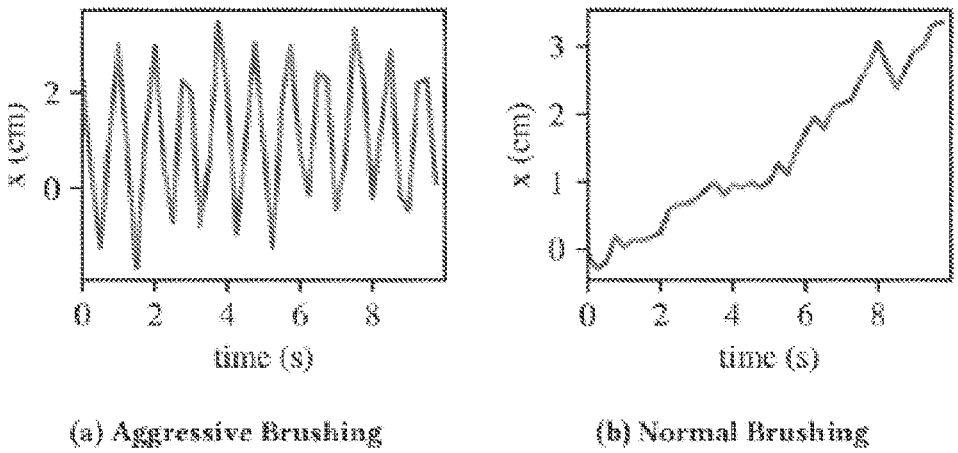
FIG. 15 is a schematic view showing motions of the tooth brush.

According to another embodiment of the present disclosure, incorrect tooth brushing detection can be implemented, which typically includes aggressive brushing detection and under-brushing and over-brushing. Aggressive tooth brushing involves periodic back and forth motions, which can be reflected by the toothbrush position changes, as shown in FIG. 15. On the other hand, when the user brushes using the correct technique that moves the brush head slowly, the x coordinate changes gradually. The aggressive brushing is detected as follows. The autocorrelation of the x coordinates within a time window of W is computed. If the period is smaller than the threshold $T_s$ and the moving distance is larger than a distance threshold $T_d$, an aggressive brushing alert will be issued to the user. The time spent on each surface is computed based on the surface recognition algorithm discussed above. For each surface, if the time is larger than $T_a$ or smaller than $T_u$, the system will remind the user for over or under brushing, respectively. Since uneven brushing tends to have lower damage in the short term, the system will provide a tooth brushing report to the user after brushing is finished, so that the user can make up for the under-brushed surfaces, or be reminded to reduce brushing the over-brushed surfaces next time.

Figure 16:
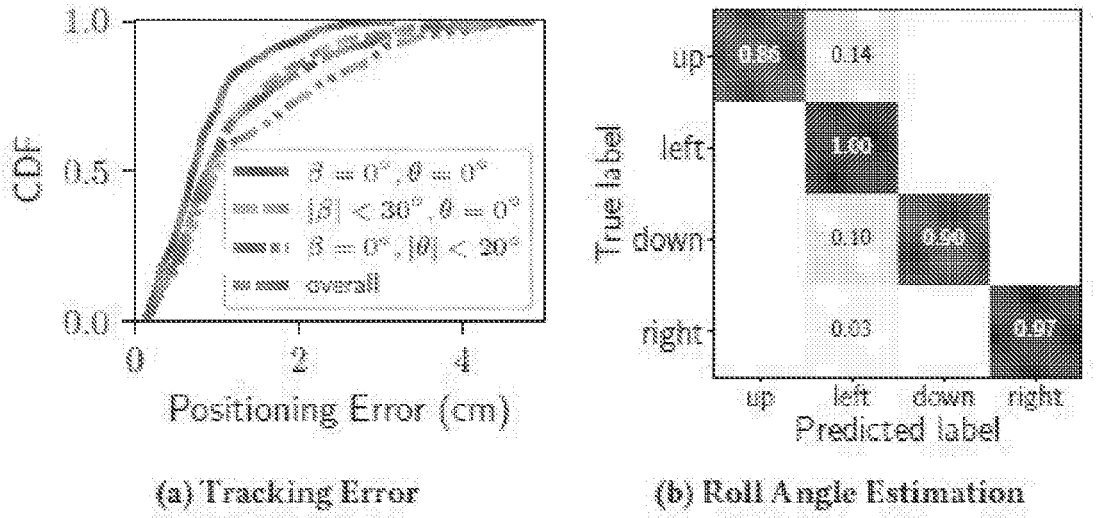
FIG. 16 is a schematic view showing evaluation results of the pose tracking of the toothbrush.

For the purpose of evaluating the DoF pose tracking, firstly a micro-benchmark experiment is conducted to evaluate electric motor tracking accuracy. In this experiment, the electric toothbrush is placed at 32 positions, with x, y, and z coordinates ranging from 0 to 12 cm, 12 to 24 cm, and 0 to 4 cm, respectively. Meanwhile, the motor orientation is changed while it was in these positions. The pitch angle β is switched from −30 degree to 30 degrees, with 30 degrees apart, and the yaw angle θ from −20 degree to 20 degrees, with 10 degrees apart. The tracking error is represented by the distance between the predicted position and the ground truth position. The results are shown in FIG. 16. As shown, when the motor has no orientation changes, i.e., β=0 and θ=0, the 90% percentile tracking error is 1.6 cm. When orientation changes, the tracking accuracy decreases slightly. When the pitch angle β is changed between −30° and 30°, the 90% percentile error is 2.2 cm. When the yaw angle θ changed between [−20°, 20°], the 90% percentile error is 3.0 cm.

For the purpose of evaluating the roll angle estimation, firstly the data are collected when the users were brushing teeth, which involve rolling the toothbrush to clean different surfaces. In total, there are more than 100 minutes of data from 10 users, and over 18431 data points used in the evaluation. The results are shown in FIG. 16. On average, over 94% of roll angles are recognized correctly. The recognition accuracy for the left and right orientation are close to 100%, while the recognition accuracy for the up orientation is about 86%. Since, during data collection, the toothbrush is moving around the users' teeth, it also demonstrates that the algorithm is robust to small position and orientation changes.

For example, 14 volunteers have been recruited and each volunteer is asked to brush 5-10 sessions, each session ranging from 1 minute to 4 minutes. An observer recorded all the tooth brushing surface ground truths. The volunteers included three females and eleven males, with heights ranging from 155 cm to 185 cm. The system is adjusted according to each user's height. Ten participants were in late twenties, one was in late thirties, and three were in late fifties. To enable the evaluation of uneven brushing detection, different brushing duration requirements are set for different surfaces. Brushing for over 10 seconds is labeled as over-brushing, and below 5 seconds as under-brushing. In total, there are 102 tooth brushing sessions are labeled.

Figure 17:
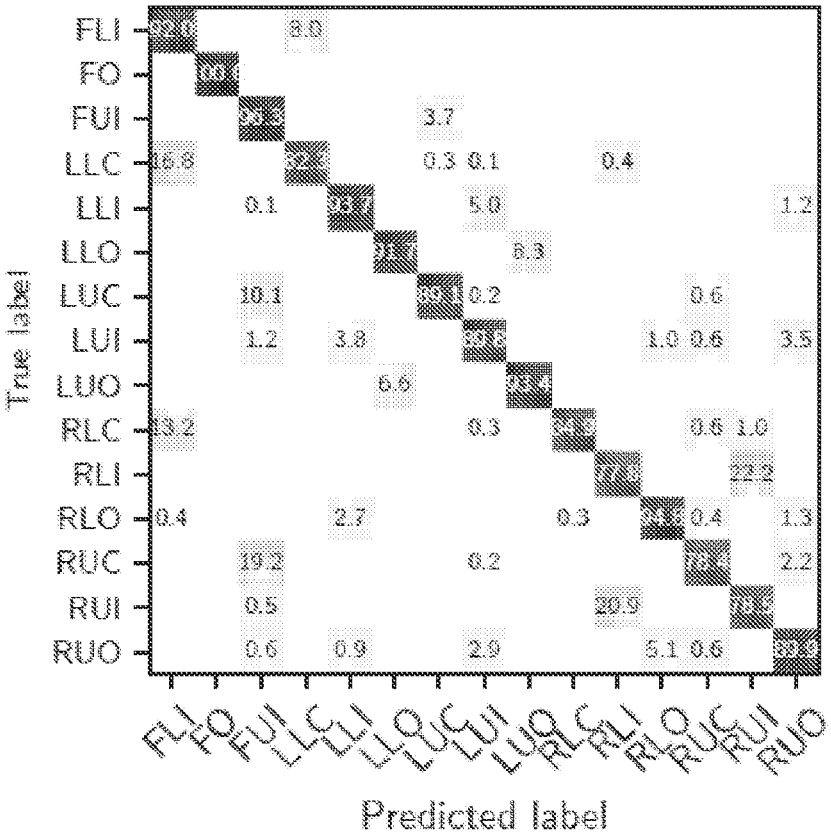
FIG. 17 is a schematic view showing overall tooth brushing surface recognition results.

Each user tried to stay in the same location each time, but there were no deliberate measurements for the user standing locations. As a result, small variations did exist. The overall tooth brushing surface recognition results are shown in FIG. 17. The surface recognition precision, recall, and f1 scores are 85.4%, 85.5%, and 85.4%, respectively. Based on the results, in general, most brushing surfaces are correctly recognized.

As shown in FIG. 17, a major source of error is that difficulties in differentiating upper or lower surfaces. For example, there are 21.5% of wrong recognition from Right Lower Inner (RLI) to Right Upper Inner (RUI), and 19.4% of the opposite direction. There are also 8.8% of wrong recognition from Left Lower Outer (LLO) to Left Upper Outer (LUO), and 6.6% of the opposite direction. This is because, in some cases, the distances between the upper and lower surfaces are small so that they can introduce errors.

Figure 18:
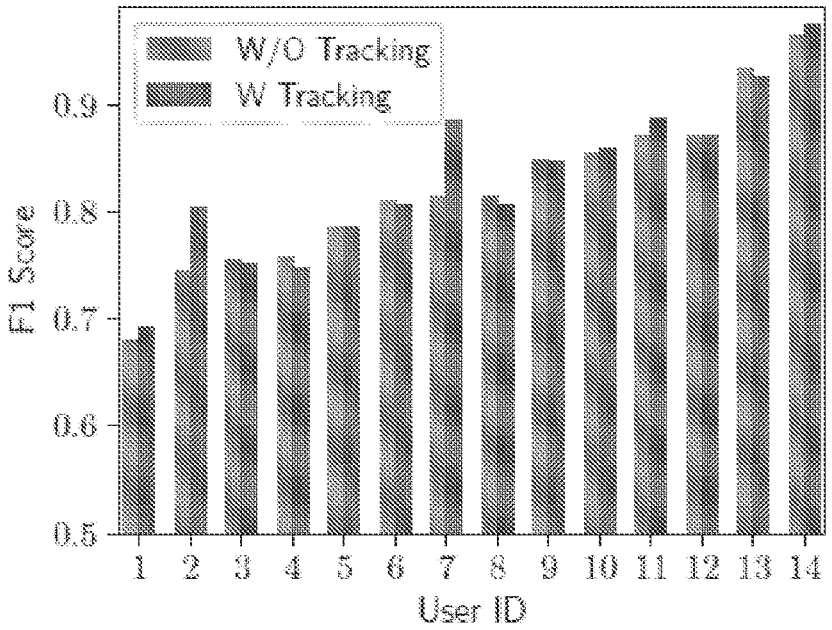
FIG. 18 is a schematic view showing the surface detection accuracy of the system with respect to different users.

Investigation has been conducted to determine how individual variations influence the surface recognition accuracy. FIG. 18 is a schematic view showing the surface detection precision, recall, and f1 scores for all the 14 users with and without head pose and location tracking. As shown, there are two users (number 13 and number 14), achieving over 90% of the surface recognition f1 score. The detection accuracies for different users vary between around 70% to 95%. The monitoring accuracy variations among different users are caused by many factors, including mouth structure, the distance between a user and the sensor, user movements during brushing, and personal brushing habits.

Figure 19:
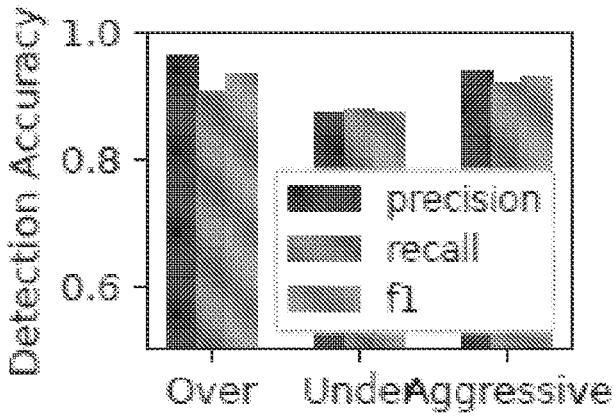
FIG. 19 is a schematic view showing incorrect tooth brushing detection results.

To evaluate aggressive brushing detection, an additional experiment is conducted, which includes ten tooth brushing sessions, with the user brushing teeth using back-forth motions. In total, there are 120 instances of aggressive brushing, and 740 instances of normal brushing. Afterwards, whether the algorithm of the present disclosure can differentiate aggressive brushing data from other normal brushing data is evaluated. To evaluate over/under brushing, the same dataset described previously are used. Specifically, there are 452, 190, and 101 instances of normal, over, and under brushing in the dataset, respectively. The incorrect tooth brushing detection results are shown in FIG. 19. The f1 scores of detection for over-brushing, under-brushing, and aggressive brushing are 93.2%, 87.4%, and 92%, respectively. Since the over-brushing and aggressive brushing are potentially more damaging, the user needs to be alerted immediately once they are detected. The miss detection rates, which equal 1 minus recall rates, for over-brushing and aggressive brushing are 10% and 8%, respectively. On the other hand, the under-brushing cause less immediate damage, so the system can aggregate the tooth brushing data over several brushing sessions, and remind the user to increase brushing time for specific surfaces.

Next, two existing commercial systems are tested for providing a baseline comparison between the magnetic sensing based system of the present disclosure with existing camera and IMU-based systems. Oral B and Kolibree electric toothbrushes were used in this test. Oral B system used a smartphone camera to monitor the user's tooth brushing, while Kolibree used the toothbrush onboard IMU sensors. Both systems only detected brushing quadrants or sextants instead of tooth surfaces, as each quadrant of the teeth contains three surfaces. For example, the left upper quadrant contains LUO, LUC, and LUI surfaces. To compare with these systems, the algorithm is adjusted to generate quadrant recognition results.

Figure 20:
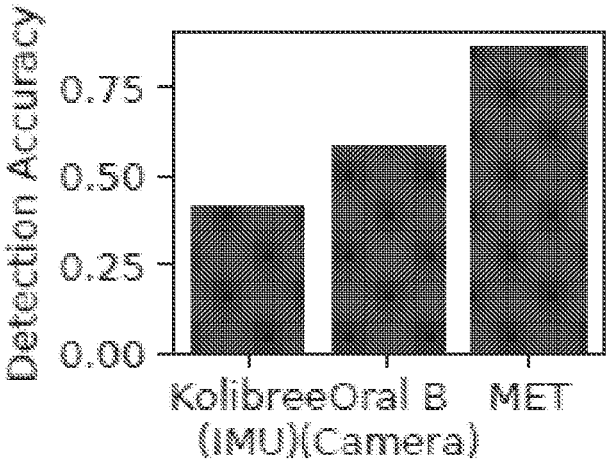
FIG. 20 is a schematic view showing detection results of the system of the present disclosure and two market-available systems.

In this experiment, an Oral B toothbrush is used to brush three times, and the system of the present disclosure and the Oral B app are used concurrently to monitor the tooth brushing. Afterwards, the Kolibree app is used to monitor tooth brushing with the Kolibree toothbrush separately. The detection results are shown in FIG. 20. As shown, the system of the present disclosure outperforms the two known systems. Specifically, Kolibree and Oral B achieve 41% and 58% of accuracy, respectively. In contrast, the MET system of the present disclosure achieves 86% of detection accuracy. During the experiment, certain drawbacks of the existing systems have been observed. The Kolibree toothbrush accurately tracked the toothbrush roll angle, but it was insensitive to the subtle brushing position changes under mechanical vibrations during electric tooth brushing. As a result, it has large errors in differentiating the left, right, up, and down surfaces that have the same roll angle. The Oral B system requires careful alignment of the user's head position each time before brushing: the user needs to make sure their face appears inside a small area within the camera image. In general, it can differentiate different tooth quadrants. However, the system does not perform well when there are variations in the toothbrush orientation: a small change in the toothbrush yaw angle can confuse the system between left and right quadrants. Similarly, a small change in the toothbrush pitch angle can confuse the system about the upper and lower quadrants. Its performances degrade would further when the user is in poor lighting conditions.

Figure 21:
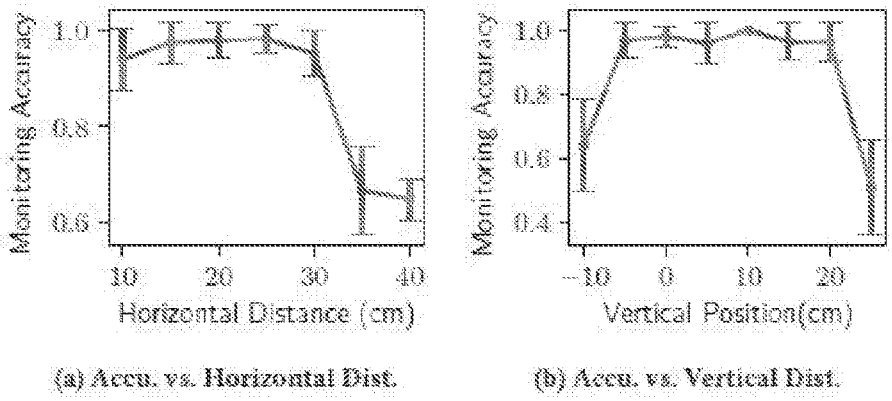
FIG. 21 is a schematic view showing surface recognition accuracy.

Experiments have been conducted to test the range for the system to achieve reliable monitoring. In a first experiment, the horizontal distance between the user's chin and the sensor is gradually increased. Tooth brushing is conducted four times at each distance. The mean and variance of the surface recognition accuracy are shown in FIG. 21. When the distance is less than 30 cm, the system maintains over 90% of monitoring accuracy. When the distance is larger 35 cm, the monitoring accuracy begins to drop, and the variations also increase. At a distance of 40 cm, the average monitoring accuracy 62%. In a second experiment, the monitoring accuracy is tested, when the vertical alignment between the sensor and the user is adjusted. The results are also shown in FIG. 21. The vertical position is defined as the difference between the user's chin's height and the height of the lower row of the sensors. As shown, when the vertical position is between −5 cm to 20 cm, the monitoring accuracy is above 90%. When the position is below −5 cm or above 25 cm, the monitoring accuracy drops to about 70% and 50%. The vertical monitoring range is sufficient to handle the issue of a user changing height when brushing teeth, such as wearing different shoes. In addition, the system will benefit from a user-friendly wall mount that can be adjusted according to the height of the user.

While the invention has been shown and described with reference to certain embodiments of the present invention thereof, it will be understood by those skilled in the art that various changes in from and details may be made therein without departing from the spirit and scope of the present invention and equivalents thereof.

What is claimed is:

1. A system for monitoring and analyzing activities of a user operating a hand tool having an electric motor, wherein the hand tool is movable by the user to process a predetermined target area having a plurality of surfaces, the system comprising:

a magneto-inductive sensor array being configured to detect a magnetic field induced by motions of the electric motor, wherein the magneto-inductive sensor array is further configured to generate a plurality of signals each having a signal strength representative of a strength of the magnetic field and a signal waveform representative of a waveform of the magnetic field; and a hardware process being configured to:

receive the plurality of signals;

determine a position of the hand tool by applying the signal strengths to a motor magnetic model;

determine a roll angle of the hand tool by applying the signal waveforms to a signal waveform model; and determine a surface of the plurality of surfaces of the predetermined target area based on the position and the roll angle of the hand tool, wherein the surface is being processed by the hand tool.

2. The system according to claim 1, wherein the magneto-inductive sensor array comprises at least five magnetic induction coils.

3. The system according to claim 2, wherein the plurality of magnetic induction coils comprises eight magnetic induction coils arranged in a matrix of 2×4.

4. The system according to claim 1, wherein the position determined by the motor magnetic model is defined by a distance along the x axis, a distance along the y axis, a distance along the z axis, a yaw angle and a pitch angle.

5. The system according to claim 4, wherein the hardware processor is further configured to:

determine whether there are periodic repetitive motions of the hand tool along the x axis based on the position and the roll angle of the hand tool; and generate an alarm signal based on a determination that there are periodic repetitive motions of the hand tool along the x axis.

6. The system according to claim 4, wherein the hardware processor is further configured to:

determine whether each surface of the plurality of surfaces of the predetermined target area has been processed by the hand tool; and generate a completion signal based on a determination that each surface of the plurality of surfaces of the predetermined target area has been processed by the hand tool.

7. The system according to claim 4, wherein the hardware processor is further configured to:

determine a period of time, during which the surface of the plurality of surfaces of the predetermined target area is being processed by the hand tool; and generate an alarm signal based on a determination that the period of time is not within a predetermined range.

8. The system according to claim 1, wherein the hand tool comprises an electric toothbrush and the predetermined target area comprises the teeth of the user having sixteen brushing surfaces; and wherein the hardware process is configured to:

determine a position of the electric toothbrush;

determine a roll angle of the electric toothbrush; and determine a surface of the sixteen brushing surfaces of the teeth, wherein the surface is being cleaned by the electric toothbrush.

9. A method for monitoring and analyzing activities of a user operating a hand tool having an electric motor, wherein the hand tool is movable by the user to process a predetermined target area having a plurality of surfaces, the method comprising:

receiving a plurality of signals each having a signal strength and a signal wave form, wherein the signal strength is representative of a strength of a magnetic field induced by motions of the electric motor, wherein the signal waveform representative of a waveform of the magnetic field;

determining a position of the hand tool by applying the signal strengths to a motor magnetic model;

determining a roll angle of the hand tool by applying the signal waveforms to a signal waveform model; and determining a surface of the plurality of surfaces of the predetermined target area based on the position and the roll angle of the hand tool, wherein the surface is being processed by the hand tool.

10. The method according to claim 9, wherein the position determined by the motor magnetic model is defined by a distance along the x axis, a distance along the y axis, a distance along the z axis, a yaw angle and a pitch angle.

11. The method according to claim 10, further comprising:

determining whether there are periodic repetitive motions of the hand tool along the x axis based on the position and the roll angle of the hand tool; and generating an alarm signal based on a determination that there are periodic repetitive motions of the hand tool along the x axis.

12. The method according to claim 10, further comprising:

determining whether each surface of the plurality of surfaces of the predetermined target area has been processed by the hand tool; and generating a completion signal based on a determination that each surface of the plurality of surfaces of the predetermined target area has been processed by the hand tool.

13. The method according to claim 10, further comprising:

determining a period of time, during which the surface of the plurality of surfaces of the predetermined target area is being processed by the hand tool; and generating an alarm signal based on a determination that the period of time is not within a predetermined range.

14. The method according to claim 9, wherein the hand tool comprises an electric toothbrush and the predetermined target area comprises the teeth of the user having sixteen brushing surfaces; and the method comprising:

determining a position of the electric toothbrush;

determining a roll angle of the electric toothbrush; and determining a surface of the sixteen brushing surfaces of the teeth, wherein the surface is being cleaned by the electric toothbrush.

15. A computer program product for use with a computer, the computer program product comprising a computer readable storage medium having recorded thereon a computer-executable program for causing the computer to perform a process for monitoring and analyzing activities of a user operating a hand tool having an electric motor, wherein the hand tool is movable by the user to process a predetermined target area having a plurality of surfaces, the process comprising:

receiving a plurality of signals each having a signal strength and a signal wave form, wherein the signal strength is representative of a strength of a magnetic field induced by motions of the electric motor, wherein the signal waveform representative of a waveform of the magnetic field;

determining a position of the hand tool by applying the signal strengths to a motor magnetic model;

determining a roll angle of the hand tool by applying the signal waveforms to a signal waveform model; and determining a surface of the plurality of surfaces of the predetermined target area based on the position and the roll angle of the hand tool, wherein the surface is being processed by the hand tool.

16. The computer program product according to claim 15, wherein the position determined by the motor magnetic model is defined by a distance along the x axis, a distance along the y axis, a distance along the z axis, a yaw angle and a pitch angle.

17. The computer program product according to claim 16, wherein the process further comprises:

determining whether there are periodic repetitive motions of the hand tool along the x axis based on the position and the roll angle of the hand tool; and generating an alarm signal based on a determination that there are periodic repetitive motions of the hand tool along the x axis.

18. The computer program product according to claim 16, wherein the process further comprises:

determining whether each surface of the plurality of surfaces of the predetermined target area has been processed by the hand tool; and generating a completion signal based on a determination that each surface of the plurality of surfaces of the predetermined target area has been processed by the hand tool.

19. The computer program product according to claim 16, wherein the process further comprises:

determining a period of time, during which the surface of the plurality of surfaces of the predetermined target area is being processed by the hand tool; and generating an alarm signal based on a determination that the period of time is not within a predetermined range.

20. The computer program product according to claim 15, wherein the hand tool comprises an electric toothbrush and the predetermined target area comprises the teeth of the user having sixteen brushing surfaces; and wherein the process comprises:

determining a position of the electric toothbrush;

determining a roll angle of the electric toothbrush; and determining a surface of the sixteen brushing surfaces of the teeth, wherein the surface is being cleaned by the electric toothbrush.

21. The system of claim 1 wherein the magneto-inductive sensor array is at a location remote from the hand tool.

22. The system according to claim 21, wherein the magneto-inductive sensor array is disposed on a surface of a wall.

23. The method of claim 9 wherein the receiving of the plurality of signals is at a location remote from the hand tool.

24. The computer program product of claim 15 wherein the receiving of the plurality of signals is at a location remote from the hand tool.

* * * * *